US009578433B2

(12) United States Patent
Crocco et al.

(10) Patent No.: US 9,578,433 B2
(45) Date of Patent: Feb. 21, 2017

(54) METHOD FOR SELF-CALIBRATION OF A SET OF SENSORS, IN PARTICULAR MICROPHONES, AND CORRESPONDING SYSTEM

(75) Inventors: Marco Crocco, Ovada (IT); Alessio Del Bue, Albissola Marina (IT); Vittorio Murino, Rapallo (IT)

(73) Assignee: FONDAZIONE ISTITUTO ITALIANO DI TECNOLOGIA, Genoa (IT)

( * ) Notice: Subject to any disclaimer, the term of this patent is extended or adjusted under 35 U.S.C. 154(b) by 389 days.

(21) Appl. No.: 14/122,418

(22) PCT Filed: May 24, 2012

(86) PCT No.: PCT/IB2012/052600

§ 371 (c)(1),
(2), (4) Date: Jan. 31, 2014

(87) PCT Pub. No.: WO2012/164448

PCT Pub. Date: Dec. 6, 2012

(65) Prior Publication Data

US 2014/0192991 A1 Jul. 10, 2014

(30) Foreign Application Priority Data

May 27, 2011 (IT) ..... TO2011A0464

(51) Int. Cl.
*H04R 29/00* (2006.01)

(52) U.S. Cl.
CPC ..... *H04R 29/005* (2013.01)

(58) Field of Classification Search
None
See application file for complete search history.

(56) References Cited

FOREIGN PATENT DOCUMENTS

EP 1443804 A2 8/2004

OTHER PUBLICATIONS

Gibson et. al. "Maximum-Likelihood Parameter Estimation of Bilinear Systems." IEEE Transactions on automatic control, vol. 50 No. 10, Oct. 2005. pp. 1581-1596.*
International Search Report for PCT/IB2012/052600 dated Sep. 21, 2012.

(Continued)

*Primary Examiner* — Curtis Kuntz
*Assistant Examiner* — Qin Zhu
(74) *Attorney, Agent, or Firm* — Heslin Rothenberg Farley & Mesiti P.C.; Victor A. Cardona, Esq.

(57) ABSTRACT

A method for the self-calibration of the position of a set of sensors of acoustic signals includes a set of sources of acoustic events provided for generating acoustic waves; measuring times of flight of the acoustic events between each source of acoustic events and each microphone; and reconstructing the positions of the set of sensors and the positions of the sources of acoustic events through a maximum-likelihood estimation procedure executed on the basis of the measured times of flight. Times of emission of the acoustic events are acquired and times of flight are obtained. Distances are calculated between the sources and the sensors. A matrix of estimated positions of the sensor microphones and a matrix of estimated positions of the sources of events are calculated.

12 Claims, 6 Drawing Sheets

(56) References Cited

OTHER PUBLICATIONS

Birchfield et al; "Microphone Array Position Calibration by Basis-Point Classical Multidimensional Scaling," Speech and Audio Processing, IEEE Transactions, vol. 13, No. 5, pp. 1025-1034, Sep. 2005.
Wu et al; "Clock Synchronization of Wireless Sensor Networks," Signal Processing Magazine, IEEE, vol. 28, No. 1, pp. 124-138, 2011.
Biswas et al; "A Passive Approach to Sensor Network Localization," Intelligent Robots and Systems, 2004, (IROS 2004), Proceedings, 2004 IEEE/RSJ International Conference, vol. 2, Sep. 2004, pp. 1544-1549.
Thrun et al; "Affine Structure from Sound," Proceedings of Conference on Neural Information Processing Systems (NIPS), MIT Press, 2005, pp. 1353-1360.
Raykar et al; "Position Calibration of Microphones and Loudspeakers in Distributed Computing Platforms," IEEE Transactions on Speech and Audio Processing, IEEE Service Center, New York, New York, US, vol. 13, No. 1, Jan. 1, 2005.
Boon Chong Ng et al; "Sensor-Array Calibration Using a Maximum-Likelihood Approach," IEEE Transactions on Antennas and Propogation, IEEE Service Center, Piscataway, New Jersey, vol. 44, No. 6, Jun. 1, 1996.
Raykar et al., "Automatic Position Calibration of Multiple Microphones", Perceptual Interfaces and Realities Lab, University of Maryland, CollegePark, 0-7803-8484-9/04 2004, IEEE, pp. IV-69-72.

* cited by examiner

METHOD FOR SELF-CALIBRATION OF A SET OF SENSORS, IN PARTICULAR MICROPHONES, AND CORRESPONDING SYSTEM

CROSS REFERENCE TO RELATED APPLICATIONS

This application is a 371 National Phase of PCT International Application No. PCT/IB2012/052600 filed on May 24, 2012, and published in English as WO 2012/164448 A1 on Dec. 6, 2012, which claims priority to Italian Patent Application No. TO2011A000464 filed on May 27, 2011, the entire disclosures of which are incorporated herein by reference.

The present invention relates to techniques for self-calibration of the position of a set of sensors of acoustic signals, in particular microphones, arranged in a region of space, comprising providing in said region of space a set of sources of acoustic events, in particular transducers designed to generate acoustic waves, measuring times of flight of said acoustic events between each source of acoustic events and each microphone, and reconstructing the positions of the set of microphones and the positions of the sources of acoustic events through a maximum-likelihood estimation procedure executed on the basis of said measured times of flight.

In many applications that use a set of sensors arranged in the environment, it is necessary to know precisely the position of the sensors. For example, in methods that estimate the direction of arrival of an acoustic signal or use beamforming techniques, an imperfect knowledge of the positions of the sensors can jeopardize to a considerable extent the possibility of achieving performance close to the performance that can be theoretically obtained.

To overcome this problem, it is frequently necessary to use geometrical configurations of sensors, the positions of which are known beforehand. However, this solution frequently proves difficult to apply, and at times altogether impracticable, in particular when a large number of sensors are distributed in the field.

This makes it necessary to estimate a posteriori the positions of the sensors. The exact determination of the positions in a three-dimensional reference is not, however, a simple operation. Of particular complexity is the self-calibration of the positions of the sensors, i.e., a procedure in which a set of events, the degree of knowledge of which is variable, is used to determine the position of the sensor.

For the purposes of the present description, defined as "event" is an acoustic signal that propagates in space, which originates from a source, or generator of events, located in a generally unknown position.

The self-calibration procedures discussed herein apply in general to acoustic signals and to sensors such as microphones and hydrophones, where the events are represented, for example, by environmental sounds or predefined sounds emitted by acoustic transducers.

Self-calibration via sources of events is advantageous as compared to methods not based upon external events. They envisage measuring, for example, via laser measurement of distance, the distance between all the pairs of sensors and applying algorithms such as MultiDimensional Scaling (MDS) to obtain the spatial positions, as described, for example, in S. Birchfield and A. Subramanya, "Microphone array position calibration by basis-point classical multidimensional scaling," Speech and Audio Processing, IEEE Transactions on, vol. 13, No. 5, pp. 1025-1034, September 2005. However, if the number of the sensors is large or said sensors are arranged in positions difficult to measure, said methods are laborious and complex, or even altogether unfeasible for many applications.

In said contexts, methods that exploit sources of events by measuring the time of arrival, the phase, or the intensity of the signals acquired by each sensor, reconstructing the form of the array through a maximum-likelihood estimation, can hence prove more convenient.

Since, however, also the positions of the sources of events are usually unknown, such methodologies lead to minimizing a nonlinear cost function, which can easily lead to identifying a suboptimal solution, i.e., a local minimum instead of the global minimum.

To overcome this drawback, it is known to introduce additional constraints, for example, measuring the times of flight, simplifying the calculation with the assumption that all the sources of events are in far field with respect to the sensors. Alternatively, it is envisaged to obtain a maximum-likelihood estimate by applying MultiDimensional Scaling to a matrix of times of flight measured between each pair of sensors, but this approach requires the source to be very close to a subset of positions of sensors. Other solutions envisage knowing the position of a subset of sensors and obtaining the others via incremental estimation. Other methods start from the hypothesis of a subset of sensors arranged linearly in order to reduce the number of unknowns, or else operate with the sensors arranged in a plane and on the basis of a prior rough estimate of the positions.

The hypotheses referred to above for obtaining constraints are frequently not admissible in the case where it is required to operate in non-constrained working conditions and can thus restrict to a remarkable extent the field of applicability of the self-calibration methods.

Other methods envisage fixing on structures the transducers that generate the events, for example, at the vertex of pyramidal volumes that enclose the majority of the set of sensors; however, said structures are far from practical and are cumbersome, above all for indoor applications.

The object of the present invention is to provide a method that will be able to make a precise estimation of the positions, avoiding the effects of local minima and that will be usable in a vast range of working conditions and applications.

According to the present invention, said object is achieved thanks to a method having the characteristics recalled specifically in the ensuing claims, which form an integral part of the present description.

The invention also regards the corresponding self-calibration system, as well as the corresponding computer-program product that can be directly loaded into the memory of a computer such as a processor and that comprises portions of software code for implementing the method according to the invention, when the product is run on a computer.

According to an important aspect of the invention, the method provides executing the self-calibration via the steps of acquiring the time of emission of said events, measuring said times of flight as a function of said times of emission, calculating distances between said sources and said sensors, and arranging them in a matrix of distances to be used for calculating a matrix of estimated positions via a maximum-likelihood procedure. The method comprises a minimization of a nonlinear least-squares cost function, which is a function of the co-ordinates of position of the microphones, of the co-ordinates of position of the sources of events, and of said calculated distances on the basis of the times of flight measured.

It is moreover provided to simplify said cost function via singular-value decomposition of said matrix of the distances, reformulating the nonlinear least-squares problem with respect to a smaller number of unknowns.

Thanks to the characteristics referred to above, the method according to the invention enables an estimation of the position that avoids the problem of the local minima and is usable in a vast range of applications. Moreover, with a minimal addition of constraints, the estimation can be obtained via closed-form calculation. The method is moreover suited to solving problems of missing data.

Further characteristics and advantages of the invention will emerge from the ensuing description with reference to the annexed drawings, which are provided purely by way of non-limiting example and in which.

Figure 10:
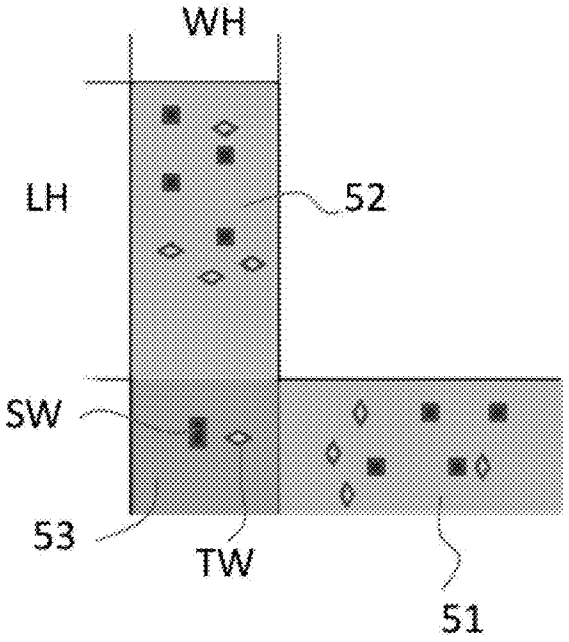
Figure 8:
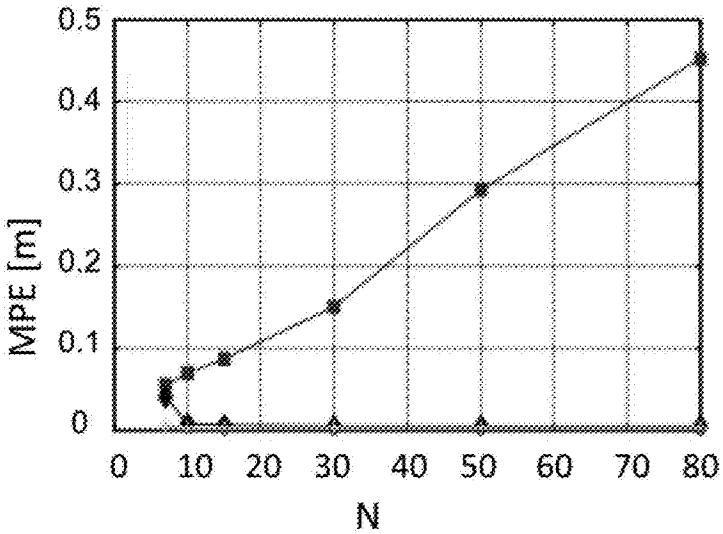
Figure 9:
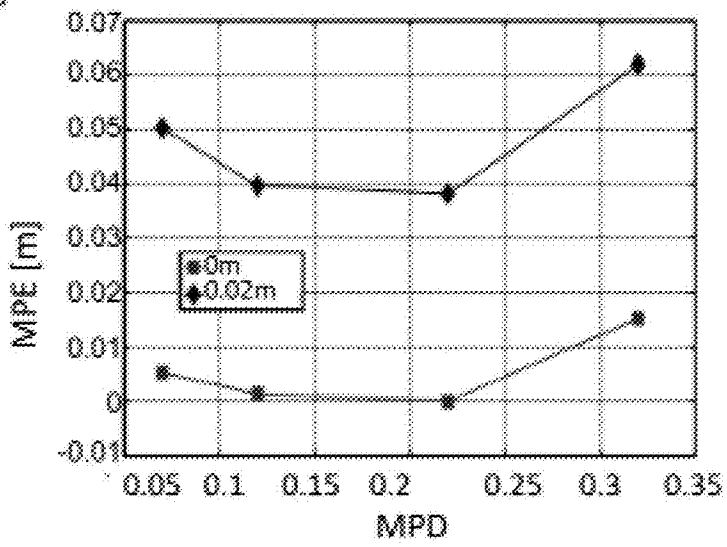
Figure 11:
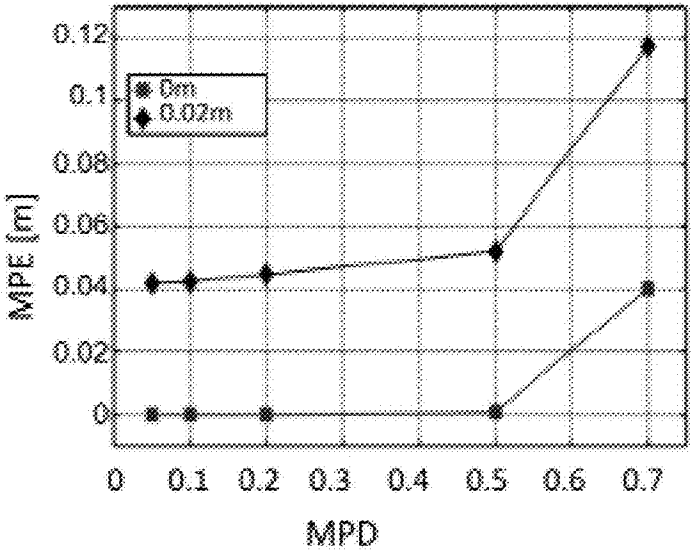

FIGS. 8, 9, and 11 show diagrams representing results obtained using the method according to the invention and variants thereof in operating configurations with missing data; and FIG. 10 is a basic diagram of an arrangement of sets of sensors and sources of events implementing the method with missing data according to the invention, The proposed method is based upon the measurement of the times of flight between the emission of an event and reception thereof at each sensor, calculated on the basis of a time of emission of the event that is known or acquired. Said time of emission constitutes a constraint for simplifying the calculation. The time of emission is acquired using a source of events synchronized with the sensors or simply associating an additional sensor to each source of events.

Said procedure advantageously requires only one additional sensor to carry out calibration of the array of sensors.

The proposed method, on the basis of the system of sensors and sources and of the conditions described above, provides transforming the original procedure of calculation that involves estimation of the position of the sensors via nonlinear least-squares minimization of a cost function in a calculation procedure principally comprising the steps of:

performing a singular-value decomposition (SVD) reformulating the nonlinear least-squares problem with 3×(N+M) unknowns, where N is the number of the sensors and M the number of the transducers, to obtain an equivalent problem with only 9 unknowns; and finding the values of said nine unknowns by solving a simpler nonlinear least-squares problem.

According to a preferred aspect, it is provided to arrange a source-of-event transducer and a sensor in the same position. This enables solution of the least-squares problem of the second step in closed form.

The method according to the invention hence uses the entire information regarding the time of flight and contemplates only that, during acquisition of all the times of flight, the sensors do not vary their position in time, it being pointed out that a possible additional sensor is used exclusively for synchronization. This represents a hypothesis of rigidity that generates constraints of rank for the matrix in which the measured times of flight that can be used for finding a solution are stored.

According to a preferred embodiment of the invention, it is envisaged to obtain a three-dimensional estimation of the position of the microphones via a further step of nonlinear optimization of the original cost function.

The approximation that is obtained via the closed-form calculation, since it is located in the vicinity of the global minimum, advantageously facilitates the convergence towards the optimal solution without falling into local minima.

A further aspect of the method according to the invention envisages an iterative procedure that enables execution even in the presence of a large amount of missing data from the sensors with a negligible loss in performance. The problem of the missing data arises when only a subset of the sensors can measure each sound event and/or, conversely, only one subset of the sounds emitted reaches all the sensors. This arises on account, for example, of malfunctioning or the presence of architectural barriers.

Figure 1:
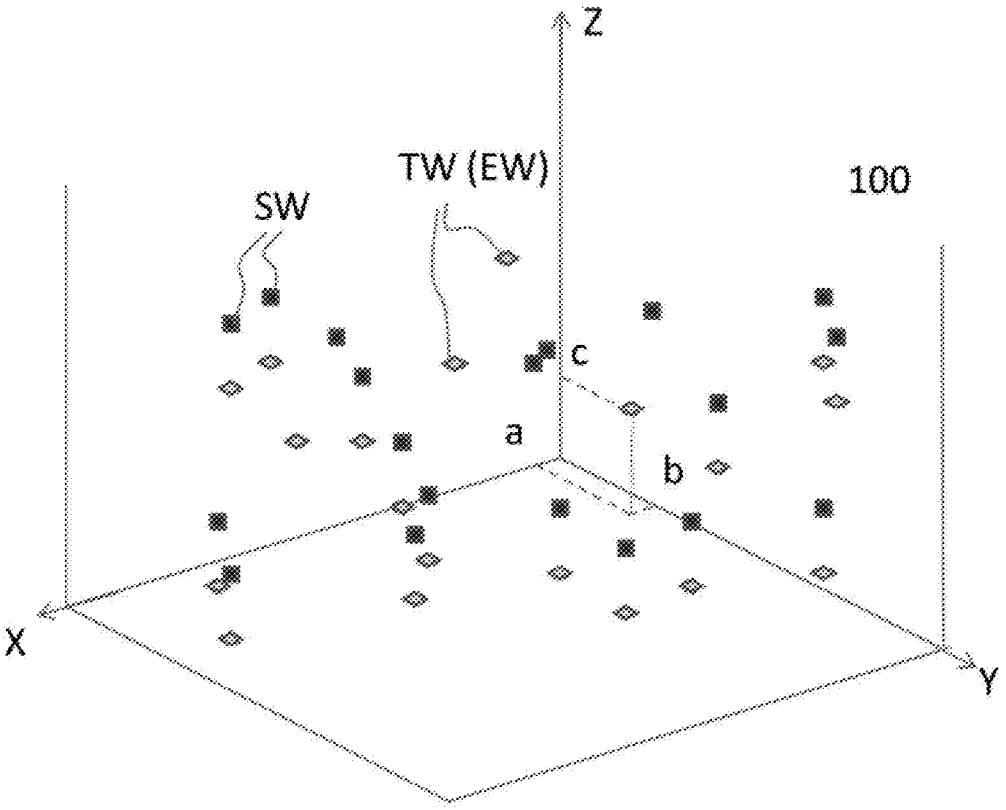
FIG. 1 is a basic diagram of an arrangement of sets of sensors and sources of events that implements the method according to the invention.

Illustrated schematically in FIG. 1 is a system implementing the method according to the invention that comprises N sensors of acoustic signals SW, for example, in FIG. 1 N is 19, in particular microphones randomly arranged in a region of space 100, in the example a cube with side 1 m, together with M sources of events TW designed to generate acoustic events EW in the form of sound waves, which are also randomly arranged in the region of space 100. The sources of events TW are, for example, transducers that generate acoustic waves, such as loudspeakers.

In the sequel of the description, the position of the sources of events TW will be indifferently referred to as position of origin of the events EW, it being possible, for the purposes of the self-calibration method according to the invention, for said positions to be considered coincident.

The sensors SW operate in a synchronized way with respect to a common clock, in a way in itself known in the applications that use arrays of sensors, as, for example, described in the paper Y.-C. Wu, Q. Chaudhari, and E. Serpedin, "Clock synchronization of wireless sensor networks", Signal Processing Magazine, IEEE, vol. 28, No. 1, pp. 124-138, 2011.

In general, it is envisaged then that the sensors SW are connected via a communication network, for example, a local network of a wireless-mesh type, in which a sync signal is made available. The times of emission to the sources and the times of arrival at the sensors are evaluated and made available on the network for a computer that carries out acquisition thereof. Said computer can also implement the subsequent steps for executing estimation of position, or else these can be executed by one or more other processors, for example, processors arranged remotely. Said components of the communication network are not, on the other hand, illustrated in FIG. 1.

It is moreover envisaged to operate with events EW emitted by the sources TW in a way sufficiently spaced apart in time so that the association with the different sensors will not be ambiguous. The next event, for example, is emitted when the previous one is exhausted or has gone below a given threshold of detectability.

The N sensors of acoustic signals, in particular microphones, are arranged in a three-dimensional space in positions that are not known.

The i-th sensor $SW_i$ has co-ordinates of position ($x_i$, $y_i$, ti).

A matrix X of the positions of the sensors $SW_i$ is hence $$X = \begin{pmatrix} x_1 & y_1 & z_1 \\ x_2 & y_2 & z_2 \\ \vdots & \vdots & \vdots \\ x_N & y_N & z_N \end{pmatrix}. \tag{1}$$

Likewise, given M events EW that are generated and detected by the network of sensors SW, and designating by ($a_j$, $b_j$, $c_j$) the unknown co-ordinates of a j-th event $EW_j$ on the axes X, Y and Z, i.e., the co-ordinates of a source of events TWj, the following matrix A of the positions of the acoustic events can be defined:

$$A = \begin{pmatrix} a_1 & b_1 & c_1 \\ a_2 & b_2 & c_2 \\ \vdots & \vdots & \vdots \\ a_M & b_M & c_M \end{pmatrix}. \tag{2}$$

The difference between a measured time of arrival $t_{ai}$ of the event $EW_j$ at the sensor $SW_i$ and a time of emission $t_{Ej}$ at the source $TW_j$ acquired for the same measured time of arrival $t_{ai}$, determines a respective measured time of flight $t_{i,j}$. The times of flight $t_{i,j}$ can be expressed as $$t_{i,j} = c^{-1}\left\|\begin{pmatrix} x_i \\ y_i \\ z_i \end{pmatrix} - \begin{pmatrix} a_j \\ b_j \\ c_j \end{pmatrix}\right\| + n_{i,j} \tag{3}$$

where c is the speed of propagation of the signal, in particular the speed of sound, and $n_{i,j}$ is an independent and identically distributed Gaussian random variable with zero mean representing the error of measurement. Consequently, the distance $d_{i,j}$ estimated between the sensor SWi and the event EWj is $$d_{i,j}=c\cdot t_{i,j}. \tag{4}$$

i.e., the time of flight multiplied by the speed of sound.

The estimated distance $d_{i,j}$ is organized in a matrix of distances D of size N×M $$D = \begin{pmatrix} d_{1,1} & d_{1,2} & \dots & d_{1,M} \\ d_{2,1} & d_{2,2} & \dots & d_{2,M} \\ \vdots & \vdots & \ddots & \vdots \\ d_{N,1} & d_{N,2} & \dots & d_{N,M} \end{pmatrix}. \tag{5}$$

The steps so far described may in general be found, for example, in the paper by R. Biswas and S. Thrun, "A passive approach to sensor network localization", in Intelligent Robots and Systems, 2004, (IROS 2004), Proceedings, 2004 IEEE/RSJ International Conference on, vol. 2, September 2004, pp. 1544-1549, vol. 2, whence it is possible to derive that the maximum-likelihood estimation of the matrices of positions X and A is given by the nonlinear least-squares problem $$X^*, A^* = \underset{X,A}{\operatorname{argmin}} \sum_{i=1}^{N}\sum_{j=1}^{M}\left[\left\|\begin{pmatrix} x_i \\ y_i \\ z_i \end{pmatrix} - \begin{pmatrix} a_j \\ b_j \\ c_j \end{pmatrix}\right\| - d_{i,j}\right]^2. \tag{6}$$

The cost function is hence the quadratic difference between the Euclidean distances between the positions of the sensors and of the events and the distances measured via the times of flight.

Said minimization, as has been mentioned, is rendered problematical by the presence of numerous local minima, due to the square roots of the Euclidean distances between the sensors SW and the events EW in Eq. (6).

A method based upon the gradient with an initial random estimation of the matrices of positions A and X obtains unsatisfactory results, especially when there are significant errors of measurement and a large number of sensors and/or events, as is illustrated in detail hereinafter, with regard to FIGS. 2 to 7.

Consequently, the method according to the invention identifies a good initial choice of the matrices of positions A and X.

For this purpose, the method reformulates the problem defined in Eq. (6), which envisages 3×(N+M) unknowns, into a problem with just 9 unknowns, proceeding according to the following steps, which preliminarily reduce the equations in bilinear form into the matrices of co-ordinates of the sensors and of the events.

The bilinear conversion of the equations is in particular performed to enable application of a singular-value decomposition of a reduced matrix of the measured distances $\tilde{D}$ thus obtained, which is in particular a bilinear function of reduced matrices of positions of the sensors $\tilde{X}$ and of positions of the events $\tilde{A}$, as illustrated in what follows.

For this purpose, according to one embodiment of said bilinear conversion, it is envisaged to consider first the following set of N×M equations for i=1 . . . N and j=1 . . . M, valid in an ideal situation, without errors of measurement of the time of flight $$x_i^2+y_i^2+z_i^2+a_j^2+b_j^2+c_j^2-2x_ia_j-2y_ib_j-2z_ic_j=d_{i,j}^2. \tag{7}$$

In order to obtain a bilinear form in the matrices of co-ordinates of the sensors and of the events, it is thus envisaged to eliminate the first six quadratic terms of the system of equations (7), by subtracting the (1, j)-th equation from the (i, j)-th equation for i=2 . . . N and j=1 . . . M, to obtain a set of (N−1)×M equations $$x_i^2+y_i^2+z_i^2-x_1^2-y_1^2-z_1^2-2(x_i-x_1)a_j+-2(y_i-y_1)b_j-2(z_i-z_1)c_j=d_{i,j}^2-d_{1,j}^2. \tag{8}$$

Likewise, by subtracting the (i, 1)-th equation from the (i, j)-th equation of the system of equations (8) for i=2 . . . N and j=2 . . . M, we obtain a set of (N−1)×(M−1) equations $$-2(x_i-x_1)(a_j-a_1)-2(y_i-y_1)(b_j-b_1)+-2(x_i-z_1)(c_j-c_1)=d_{i,j}^2-d_{1,j}^2-d_{i,1}^2+d_{1,1}^2. \tag{9}$$

The terms of the system of equations (9) can be organized into the following reduced matrices of positions of the sensors $\tilde{X}$, of positions of the events $\tilde{A}$, and of distances $\tilde{D}$:

$$\tilde{X} = \begin{pmatrix} x_2-x_1 & y_2-y_1 & z_2-z_1 \\ x_3-x_1 & y_3-y_1 & z_3-z_1 \\ \vdots & \vdots & \vdots \\ x_N-x_1 & y_N-y_1 & z_N-z_1 \end{pmatrix}; \tag{10}$$

-continued $$\tilde{A} = \begin{pmatrix} a_2 - a_1 & b_2 - b_1 & c_2 - c_1 \\ a_3 - a_1 & b_3 - b_1 & c_3 - c_1 \\ \vdots & \vdots & \vdots \\ a_M - a_1 & b_M - b_1 & c_M - c_1 \end{pmatrix}; \tag{11}$$

$$\tilde{d}_{i-1,j-1} = d_{i,j}^2 - d_{1,j}^2 - d_{i,1}^2 + d_{1,1}^2; \tag{12}$$

$$\tilde{D} = \begin{pmatrix} \tilde{d}_{1,1} & \tilde{d}_{1,2} & \dots & \tilde{d}_{1,M-1} \\ \tilde{d}_{2,1} & \tilde{d}_{2,2} & \dots & \tilde{d}_{2,M-1} \\ \vdots & \vdots & \ddots & \vdots \\ \tilde{d}_{N-1,1} & \tilde{d}_{N-1,2} & \dots & \tilde{d}_{N-1,M-1} \end{pmatrix}. \tag{13}$$

Using said reduced matrices, the system of equations (9) can be expressed in matrix form as $$-2\tilde{X}\tilde{A}^T = \tilde{D} \tag{14}$$

The matrix (N−1)×(M−1) of reduced distances $\tilde{D}$ has rank three, since it is the product of the matrix $-2\tilde{X}$, of size (N−1)×3, and the matrix $\tilde{A}^T$, of size 3×(M−1). By construction, these matrices demand a number N of sensors of the system greater than or equal to 4, as greater than or equal to 4 must be the number M of the sources.

By applying the SVD to the reduced matrix of distances $\tilde{D}$, in the case of absence of noise, we obtain that the singular values after the third are equal to zero; hence, it is possible to truncate as follows $$UVW = \tilde{D} \tag{15}$$

where U is an (N−1)×3 matrix constituted by the first three left-hand singular vectors of the matrix $\tilde{D}$, V is a 3×3 diagonal matrix containing the three singular values of the matrix $\tilde{D}$ different from 0, and W is a 3×(M−1) matrix constituted by the first three right-hand singular vectors of the matrix $\tilde{D}$. The form of said three matrices is in itself known from the SVD technique.

In a real situation, in the presence of a measurement of noise, the rank of the matrix of reduced distances $\tilde{D}$ is probably higher than three: in this case, only the three largest singular values in the matrix V are considered, reducing the size of U, V and W to that of the case without noise.

Once SVD has been performed, it is envisaged to use for the calculation of the nine unknowns a mixing matrix C. From the relations (14) and (15), for any 3×3 invertible matrix C the following applies $$\tilde{X} = UC$$

$$-2\tilde{A}^T = C^{-1}VW \tag{16}$$

Said mixing matrix C mixes the components obtained by SVD in order to obtain the solution according to the original problem of localization of the sensors.

Said mixing matrix C has nine elements that minimize a nonlinear least-squares cost function, exploiting the system of equations (8) that comprise the quadratic terms $x_i^2$, $y_i^2$ and $z_i^2$ previously rejected $$\min_{A,X} \sum_{i=2}^{N} \sum_{j=2}^{M} [x_i^2 + y_i^2 + z_i^2 - x_1^2 - y_1^2 - z_1^2 + -2(x_i - x_1)a_j - 2(y_i - y_1)b_j - 2(z_i - z_1)c_j - d_{i,j}^2 + d_{i,j}^2]^2 \tag{17}$$

Since the configuration of the sensors is invariant for translation, the method envisages imposing that the co-ordinates of the first microphone are at the origin of the reference system, without any loss of generality $$x_1 = 0$$

$$y_1 = 0$$

$$z_1 = 0 \tag{18}$$

Moreover, the minimum solution is invariant with respect to any rotation in three-dimensional space; hence, we can impose that the first source lies on the axis x of the reference system, thus obtaining $$b_1 = 0$$

$$c_1 = 0 \tag{19}$$

On the basis of Eqs. (18) and (19), the cost function (17) can be rewritten as $$\min_{A,X} = \sum_{i=2}^{N} \sum_{j=2}^{M} [x_i^2 + y_i^2 + z_i^2 - 2(x_i - x_1)a_j + -2(x_i - x_1)(a_j - a_1) - 2(y_i - y_1)(b_j - b_1) + -2(z_i - z_1)(c_j - c_1) - d_{i,j}^2 + d_{1,j}^2]^2 \tag{20}$$

Substituting Eq. (16) in Eq. (20), we can render explicit the dependence of the cost function upon the mixing matrix C $$C^* = \operatorname{argmin}_c \sum_{i=1}^{N-1} \sum_{j=1}^{M-1} [(u_{i1}c_{11} + u_{i2}c_{21} + u_{i3}c_{31})^2 ++ (u_{i1}c_{12} + u_{i2}c_{22} + u_{i3}c_{32})^2 ++ (u_{i1}c_{13} + u_{i2}c_{23} + u_{i3}c_{33})^2 ++ (u_{i1}c_{11} + u_{i2}c_{21} + u_{i3}c_{31})a_1 + u_{i1}v_{11}w_{1j} ++ u_{i2}v_{22}w_{2j} + u_{i3}v_{33}w_{3j} - d_{i+1,j+1}^2 + d_{1,j+1}^2]^2 \tag{21}$$

where $u_{ij}$, $v_{ij}$, $w_{ij}$ and $c_{ij}$ are the elements of the matrices U, V, W and C.

The only unknown parameter in Eq. (21), apart from the mixing matrix C, is the co-ordinate of the event $EW_1$, $a_1$ on the axis X, which must be optimized together with the matrix C using as starting value the estimated distance between the first microphone and the first source.

Alternatively, if the value of measurement of noise is quite low, the co-ordinate $a_1$ can be set equal to the value of the estimated distance. Even though the proposed method enables reduction of the problem of nonlinear optimization to a simpler one, the last step of finding the mixing matrix C equally represents a nonlinear problem that can converge in a residual local minimum.

Hence, described hereinafter is the closed-form solution, based upon the additional assumption that the position of an event coincides with the position of a sensor.

If $a_1 = x_1$, $b_1 = y_1$ and $c_1 = z_1$, and Eq. (18) applies, the co-ordinates of the first acoustic event are set at the origin $$a_1 = 0$$

$$b_1 = 0$$

$$c_1 = 0 \tag{22}$$

Hence, the matrices of the acoustic events A and of the positions of the microphones X are equal, respectively, to the reduced matrices $\tilde{A}$ and $\tilde{X}$ and the results of the SVD are directly linked to A and X so that Eq. (16) can be rewritten as $$X=UC$$

$$-2A^T=C^{-1}VW \tag{23}$$

The nine elements of the mixing matrix C can then be reduced to six if we note noting that the minimum solution is invariant with respect to rotations in the three-dimensional space. This is an intrinsic indeterminacy of the problem of localization of sensors and acoustic events, since an orbit of minimum solutions can always be obtained by applying an arbitrary rotation to the position of the sensor and its reverse to the position of the acoustic event, according to the effect of gauge freedom.

In the case of the method described herein, each real square matrix admits of a QR decomposition such that C=QR, where Q is a matrix of rotation and R a right triangular matrix. Hence, it is possible to choose the matrix Q arbitrarily as the identity matrix I. Thus, we simply have to substitute the matrix C with the matrix R in Eq. (16) to obtain $$X=UR$$

$$-2A^T=R^{-1}VW \tag{24}$$

Defining the right triangular matrix R as $$R=\begin{pmatrix} r_1 & r_2 & r_3 \\ 0 & r_4 & r_5 \\ 0 & 0 & r_6 \end{pmatrix} \tag{25}$$

the cost function (17) can be expressed in terms of matrix R using the Eq. (24)

$$R^* = \arg \min_R \sum_{i=1}^{N-1} \sum_{j=1}^{M-1} [(r_1 u_{i1})^2 + (r_2 u_{i1} + r_i u_{i2})^2 + +(r_3 u_{i1} + r_5 u_{i2} + r_6 u_{i3})^2 + u_{i1} v_{11} w_{1j} + +u_{i2} v_{22} w_{2j} + u_{i3} v_{33} w_{3j} - d^2_{i+1,j+1} + d^2_{1,j+1}]^2 \tag{26}$$

Developing the first three quadratic terms in Eq. (26) and gathering the other terms we obtain $$R^* = \operatorname{argmin}_R \sum_{i=1}^{N-1} \sum_{j=1}^{M-1} [u^2_{i1}(r_1^2 + r_2^2 + r_3^2) + u^2_{i2}(r_4^2 + r_5^2) + +u^2_{i,3} r_0^2 + 2u_{i,1}u_{i,2}(r_2 r_4 + r_3 r_5) + 2u_{i,1}u_{i,3}(r_3 r_6) + +2u_{i2}u_{i3}(r_5 r_6) - k_{ij}]^2 \tag{27}$$

where $$k_{ij} = -u_{i1} v_{11} w_{1j} - u_{i2} v_{22} w_{2j} - u_{i3} v_{33} w_{3j} + d^2_{i+1,j+1} - d^2_{1,j+1} \tag{28}$$

Defining a vector $s_i$ for i=1 . . . N as $$s_i = \begin{pmatrix} u^2_{i1} \\ u^2_{i2} \\ u^2_{i3} \\ 2u_{i1}u_{i2} \\ 2u_{i1}u_{i3} \\ 2u_{i2}u_{i3} \end{pmatrix} \tag{29}$$

a vector f as:

$$f = \begin{pmatrix} r_1^2 + r_2^2 + r_3^2 \\ r_4^2 + r_5^2 \\ r_6^2 \\ r_2 r_4 + r_3 r_5 \\ r_3 r_6 \\ r_5 r_6 \end{pmatrix} \tag{30}$$

a vector k of dimensions (N−1)×(M−1) as:

$$k = \begin{pmatrix} k_{1,1} \\ k_{2,1} \\ \vdots \\ k_{N-1,1} \\ k_{1,2} \\ \vdots \\ k_{N-1,M-1} \end{pmatrix} \tag{31}$$

and the matrix S of dimensions (N−1)×6 as:

$$S = \begin{pmatrix} s_1^T \\ s_2^T \\ \vdots \\ s_{N-1}^T \end{pmatrix} \tag{32}$$

and finally the matrix P of dimensions (N−1)×(M−1)×6 obtained by stacking M−1 times the matrix S, Eq. (26) can be expressed as a linear least-squares problem in the variable represented by the vector f, as follows:

$$f^* = \operatorname{argmin}_f = (|Pf - k|)^2 \tag{33}$$

The closed-form solution of Eq. (33) is given by:

$$f^* = (P^T P)^{-1} P^T k \tag{34}$$

The values of the matrix R can hence be easily obtained from the six elements of the matrix f, as follows:

$$r_6 = \pm\sqrt{f_3}$$

$$r_5 = f_6 / r_6$$

$$r_4 = \pm\sqrt{f_2 - r_5^2}$$

$$r_3 = f_5 / r_6$$

$$r_2=(f_4-r_3r_5)/r_4$$

$$r_1=\pm\sqrt{f_1-r_2^2-r_3^2} \tag{35}$$

where $f_i$ is the i-th element of the matrix $f^*$.

The ambiguities of sign in Eq. (35) produce eight different matrices R corresponding to the combination of three specular reflections of the entire set of co-ordinates of the microphones and of the acoustic events.

Given one of the values of the triangular matrix R found with Eq. (35), the matrices X and A can easily be obtained.

In the absence of errors of measurement of the time of flight, the argument of the global minimum of Eq. (26) is equal to the argument of the global minimum of the original problem according to Eq. (6).

Instead, the two arguments may not be identical and the solution of Eq. (26) will be sub-optimal.

Nevertheless, if the errors of measurement are not excessive, the solution of Eq. (26) falls within the region of the global minimum of Eq. (6). Consequently, the solution of Eq. (26) can be used as initial estimate for solving Eq. (6) via a gradient-descent algorithm.

As regards the problem of the missing data, in a generic scenario of positioning of the sensors it frequently occurs that a subset of sensors is located rather far from the events. This is likely to occur in an indoor installation, where architectural barriers can attenuate, shield, deflect or absorb completely the signal of the event. In this case, the measurement of the times of arrival $t_{i,j}$ is not available for a given set of sensors. As a consequence, the matrices D and $\tilde{D}$ contain missing values, preventing the closed-form solution described above, based upon an SVD procedure as in Eq. (15), from being obtained.

It is, however, still possible to solve the problem of self-calibration by estimating the values missing in the reduced matrix $\tilde{D}$ and jointly finding a factoring similar to the one provided by the SVD procedure. Hence, the solution is possible only by solving a problem of completion of the matrix with rank constraint. The only restrictive hypothesis on the missing data (condition of completeness) is that at least one row and one column of the matrix of the distances D should be complete, i.e., all the signals received by a sensor and the events transmitted by a source are available. In other words, more in general it is envisaged to arrange one of the sensors so that it may be reached by events emitted by each source of events and one of the sources of events so that it can reach all the microphones of said set of microphones.

Otherwise, on account of the construction of the values of the reduced matrix $\tilde{D}$ in Eq. (12), a single missing value of the matrix of distances D would affect an entire column or row of the reduced matrix $\tilde{D}$.

It is thus envisaged in the first place, instead of using the triad of matrices (U, V, W) in Eq. (15), to reduce the unknowns in bilinear form as F=U and G=V×W (i.e., $\tilde{D}$=F G).

We thus define a new set of variables $m:=\{m_{ij}:(i,j)\notin \mathcal{O}\}$ where the finite set $\mathcal{O}$ is such that $\mathcal{O}:=\{(i,j):D_{ij}\}$.

Said variables m are considered as representing the non-observed values of the reduced matrix $\tilde{D}$. Said variables m can be included in bilinear form, leading to the minimization of a cost function $$L(m,F,G)=\|\tilde{D}(m)-FG\|^2 \tag{36}$$

where the place value (i; j) of the matrix $\tilde{D}(m)$ is $$(\overline{D}(m))_{ij}:=\begin{cases}\overline{D}_{ij}, & \text{if } (i,j)\in\mathcal{O}\\ M_{ij}, & \text{if } (i,j)\notin\mathcal{O}.\end{cases}$$

where M is the matrix containing the non-observed values of $\tilde{D}$. The matrix $\tilde{D}(m)$ corresponds to the reduced matrix $\tilde{D}$ where the missing values are filled with the variables m. The variables to be optimized are hence now (m; F; G).

By solving said problem and filling the positions of the matrix it is possible to proceed to the estimation of the mixing matrix C as illustrated previously.

The approach adopted for optimization of the cost function $L(m,F,G)=\|\tilde{D}(m)-FG\|^2$ is of an iterative type based upon the alternation of two problems of optimization as summarized below:

setting an index 1=0 and choosing a maximum value of the cost function $L_{max}$ repeating iteratively until $1=L_{max}$ the steps of solving $$(F^{[i+1]},G^{[i+1]})=\underset{F,G}{\operatorname{argmin}}L(m^{[l]},F,G) \tag{37}$$

solving $$m^{[l+1]}=\underset{m}{\operatorname{argmin}}L(m,F^{[l+1]},G^{[l+1]}) \tag{38}$$

updating 1 to 1+1 setting $F^{(l+1)}=F^{[L_{max}]}$ and $G^{(l+1)}=G^{[L_{max}]}$.

To solve the optimization problem (37) two least-squares problems can be solved, first with respect to F (keeping G fixed) and then with respect to G (keeping F fixed). After solving for $(F^{[l+1]}, G^{[l+1]})$, the problem (38) updates the missing data. The solution of the problem (38) is obtained by substituting the (i, j)-th value of the matrix $M^{[l+1]}=G^{[l+1]}\times F^{[l+1]}$ for all the elements $(i,j)\notin\mathcal{O}$.

The approach proposed obtains a local solution for the cost function L minimized according to Eq. (36) and the performance of the algorithm of completion of said matrix with missing data depend upon the amount of missing values in the reduced matrix D.

The number of iterations can be fixed by choosing a maximum value of the cost function Lmax.

Alternatively, it is possible to make a measurement of the updating remainder of the pair $F^{[l+1]}$; $G^{[l+1]}$. Once the values of F and G have been found using the previous procedure, the right triangular matrix R is calculated, but, with respect to the construction of the cost function according to Eq. (17), the terms within the double summation, the pairs of indices (i, j) of which correspond to the missing values of the matrix D, are rejected. Described in what follows is a configuration of microphones and transducers that implements the method according to the invention, and provided by way of example are experimental data, which evaluate the performance of the method according to the invention as a function of the number of sensors and events, degree of the errors of measurement, and percentage of missing data. Also provided is a comparison of the results of the method according to the invention as compared to the results of a gradient-descent method applied to a conventional maximum-likelihood cost function, as described, for example, in S. Thrun, "Affine structure from sound", in Proceedings of Conference on Neural Information Processing Systems (NIPS), MIT Press, 2005, pp. 1353-1360. Said method is applied starting from an arbitrary estimate. Moreover, according to a preferred embodiment of the invention, it is envisaged to use the solution obtained with the method according to the invention in closed form as initial estimate of the gradient-descent method. The results obtained using said preferred embodiment of the invention are also given in the comparisons.

A system that implements the method according to the invention comprises a fixed number of sensors and sources of events positioned in a random way in a three-dimensional cubic region of side of 1 m, according to a uniform distribution, in a way similar to what is described in FIG. 1. The time of flight $t_{i,j}$ between sources and sensors is calculated simply by dividing the distance between them by the speed of propagation c of the sound event, which is set nominally at 340 m/s. To simulate errors of measurement of the time of flight, a random variable is added, with a normal distribution with zero mean and given standard deviation. For simplicity, in what follows, the errors of measurement of time of flight are converted into distance measurement errors (DME), giving the corresponding standard deviation in meters.

FIGS. 2-5 show the qualitative evaluation of the estimated position of a number N of sensors equal to 20 with respect to their real position, made using the method according to the invention and the gradient-descent method in different conditions.

Figure 2:
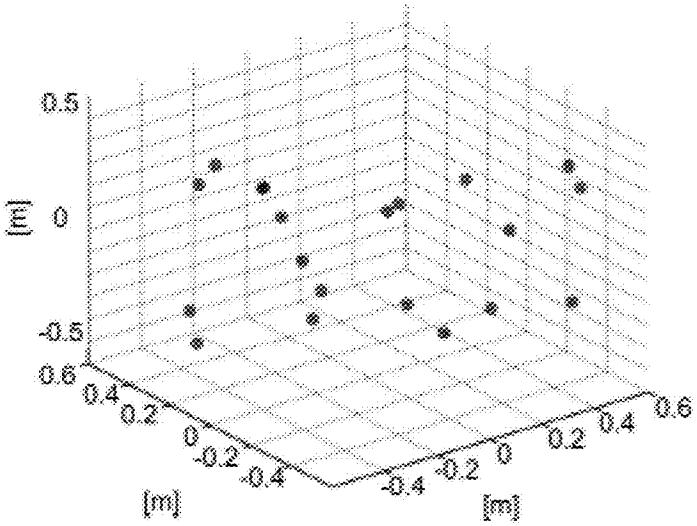
FIGS. 2 to 7 show diagrams representing results obtained using the method according to the invention and variants thereof with respect to known methods.

In FIG. 2, indicated with the circles are the real positions of the sensors SW and with crosses the estimates of the gradient-descent method. As may be seen, the estimation of the positions is altogether unsatisfactory, yielding almost random estimates on account of the presence of local minima.

Figure 3:
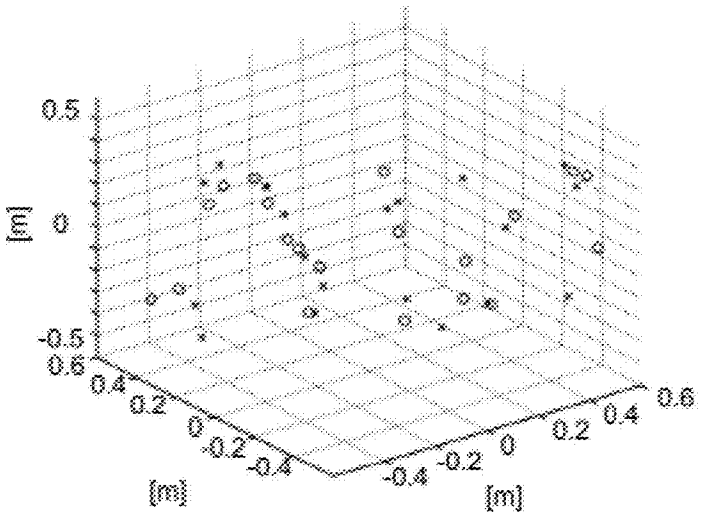
Figure 4:
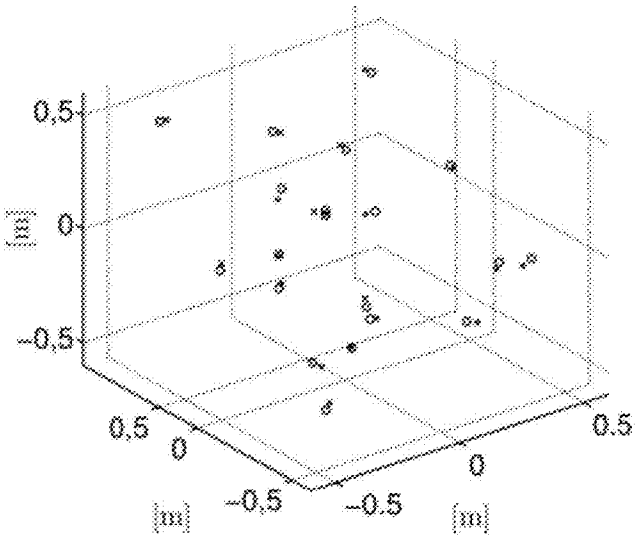
Figure 5:
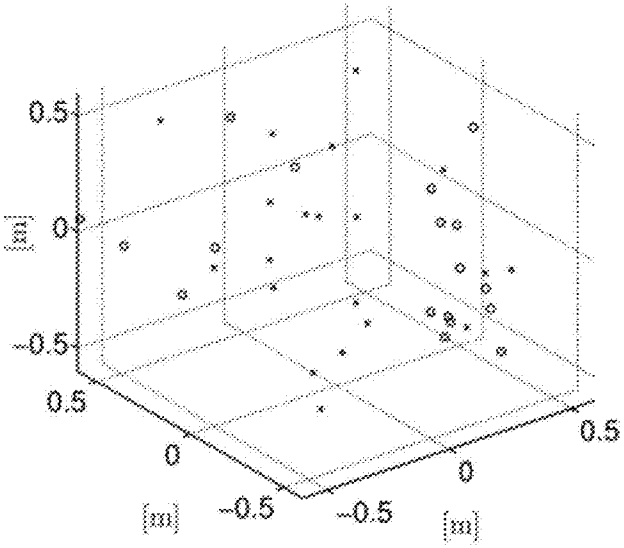
Figure 6:
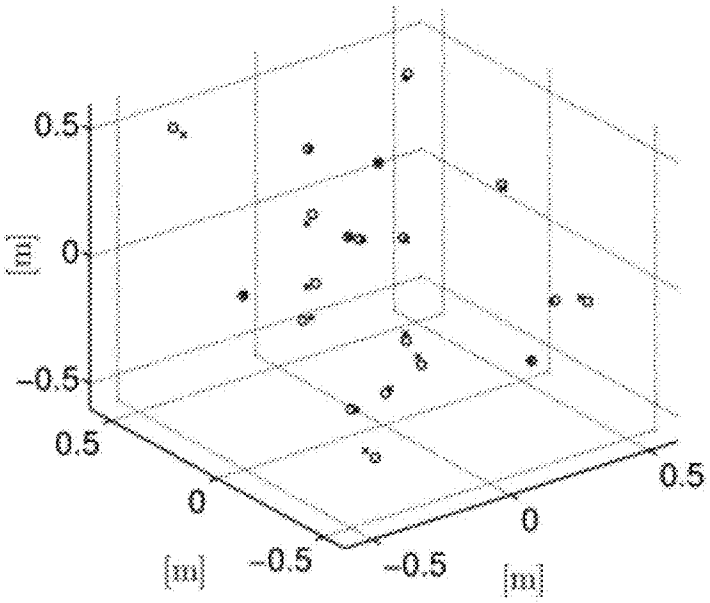

Indicated by the crosses in FIG. 3, instead, is the position estimated by the method according to the invention in closed form that converges towards the exact solution. If a standard deviation on the DME of 0.02 m is added, the gradient-descent method illustrated in FIG. 4 again produces unacceptable results, whereas the method according to the invention (FIG. 5) obtains better results. Illustrated in FIG. 6 are the results obtained using the method according to the invention in the preferred embodiment, with closed-form calculation of an initial estimate refined with the gradient-descent method, said result showing a further improvement.

Figure 7:
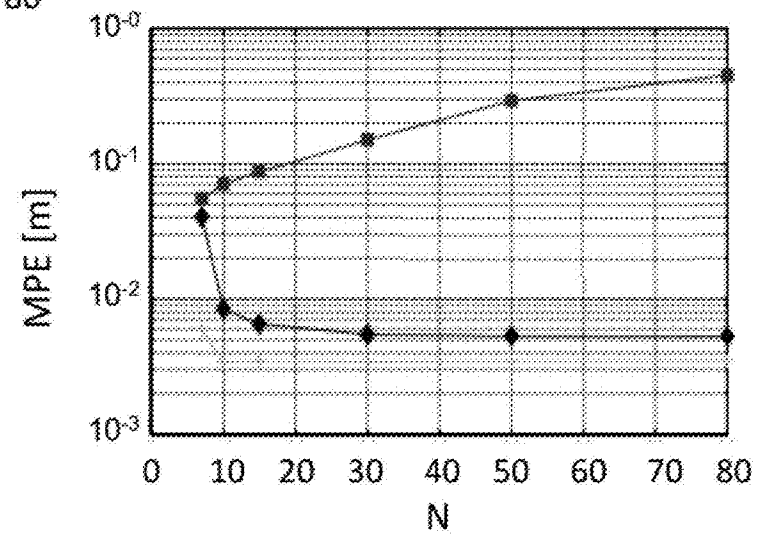

Represented in linear form and logarithmic form, respectively, in FIGS. 7 and 8 are the values of mean position error (MPE), i.e., the average of the Euclidean distances between the real values and the estimated positions, and of mean distance error as a function of the number of sensors for the estimates obtained using the method according to the invention (circles) without refinement, the gradient-descent method (rhombi), and the preferred embodiment of the method with closed-form calculation of an initial estimate refined with the gradient-descent method (crosses). It may be noted that the method proposed is markedly more precise than the gradient-descent method by itself, irrespective of the number of sensors, while its use as subsequent refinement yields even better results. The increase in the number N of sensors worsens the performance of the gradient-descent method. Instead, the method according to the invention, used by itself or with the refinement using the gradient-descent method, presents approximately constant performance, except for small numbers of sensors, where the refinement of the gradient-descent method proves more effective.

Consequently, the method according to the invention, in particular used by itself, is particularly suited to large sensor networks and/or a large number of sources of events.

Illustrated in FIG. 8 are results of simulations of the performance in the case of missing data. Two sets of experiments were conducted, simulated in two configurations.

A first configuration corresponds to the same system configuration as the one described previously, with 30 sensors and 30 events randomly distributed in a cube of 1 m of side, where the measured times of flight were perturbed with a Gaussian noise. The missing data were introduced by random elimination of a given percentage of measurements of times of flight, in particular five percentages, or missing data percentages (MDP): 0.05, 0.1, 0.2, 0.5, 0.7. Five hundred experiments were conducted for each percentage, varying at each experiment the positions of the sensors and of the sources. Illustrated in FIG. 9 is the error value MPE as a function of the percentage MPD for values of standard deviation of the error DME of 0 m (squares) and 0.02 m (rhombi).

For example, negligible values of error MPE were obtained up to approximately half of the missing data for a standard deviation of 0 m. Said first configuration is more suited to representing situations in which malfunctioning of the sensors occurs.

A second configuration simulates a more realistic distribution of missing data, due to architectural barriers, in particular, as illustrated in FIG. 10, two corridors 51 and 52 perpendicular to one another and connected so as to form a corner 53, as illustrated in FIG. 10, so that all the data of the sensor/source pairs belonging to different corridors (51, 52) are missing. Moreover, events generated in the area 53 are detected by all the sensors, and the sensors in 53 do not detect all the events, thus satisfying the condition of completeness described previously. Said scenario is more critical because entire blocks of the matrix of data may be missing. By varying the length LH of the corridors 51 and 52 the value of MDP was set, keeping the width WH fixed and randomly generating the positions of the sensors SW and the sources TW according to a uniform distribution. Illustrated in FIG. 9 are the results for corridors of 2 m in width WH, 3 m in height, with four different lengths LH of 0.5 m, 1 m, 2 m, 4 m, with the following pairs of number N of sensors and percentage value MDP: (16, 0.07), (20, 0.12), (30, 0.22), (50, 0.32).

The results in terms of MPE calculated over 500 experiments for the second configuration are represented in FIG. 11. As compared to the first configuration, the error MPE does not increase monotonically with the amount of data, but presents a minimum (at 0.22 MDP), due to the fact that in any case the increase in the number of sensors and/or sources increases the overall performance, this effect being dominant, with respect to the loss of performance due to the missing data up to the point of minimum (30, 0.22) indicated in FIG. 11. The error value MPE is as a whole higher than that of the first configuration with the cubic region, seeing that it is a more complex geometry. Also in this more complex configuration the error value MPE is not in any case very different from that of the case without missing data, also for significant percentages of MDP, such as, for example, 0.22.

In practice, the method according to the invention enables estimation of the entire matrix of times of flight, or distances derived therefrom, and consequently estimation of the position of the sensors with negligible error also for significant percentages of missing data.

Hence, the advantages of the method according to the invention emerge clearly.

The method according to the invention is able to make a precise estimation of the positions avoiding the problem of the local minima and can be employed in a vast range of working conditions and applications.

A further advantageous aspect is that, using a large number of events, the dependence of the performance upon the position of the sources is relaxed, so that it is not necessary for them to be positioned very precisely as with other known methods.

The method proposed can be advantageously used for self-calibration of microphones both in near field and in far field.

In one embodiment, the method can be implemented in two stages. In the first place, the closed-form calculation is performed to obtain an estimate of the correct localization both of the sources of events and of the positions of the sensors. Then, a nonlinear optimization of the cost function is made.

Of course, without prejudice to the principle of the invention, the details of construction and the embodiments may vary widely with respect to what has been described and illustrated herein purely by way of example, without thereby departing from the scope of the present invention.

The method and system according to the invention can be used in sensor systems for detecting acoustic signals in various applications, such as measurement of noise on machinery, acoustic prostheses, recording of sound events, recording of underwater propagations.

The method and system according to the invention in general comprise providing in the region of space a set of sources of acoustic events, in particular transducers designed to generate acoustic waves, said set comprising a number of transducers. However, the method also comprises providing, to create the set of sources, a single transducer set in different spatial locations at successive instants of time.

The invention claimed is:

1. A method for self-calibration of the position of a set of sensors of acoustic signals, arranged in a region of space, comprising:

providing in said region of space a plurality of transducers able to generate acoustic waves;

generating acoustic waves by the plurality of transducers;

receiving the acoustic waves at a plurality of sensors;

measuring times of flight of said acoustic waves between each transducer and each sensor; and determining the positions of the set of sensors and the positions of the transducers through a maximum-likelihood estimation procedure executed on the basis of said measured times of flight, acquiring times of emission of said acoustic waves;

obtaining said times of flight as a function of the respective times of emission, among said acquired times of emission;

calculating from said times of flight distances between said transducers and said sensors and arranging said distances in a matrix of distances;

calculating a matrix of estimated positions of the sensors and a matrix of estimated positions of the transducers via a maximum-likelihood procedure comprising performing a nonlinear least-squares optimization that minimizes a cost function between Euclidean distances of the positions of the sensors and of the transducers and said calculated distances; and processing a set of equations associated to said maximum-likelihood procedure for calculating a reduced matrix of the measured distances as a bilinear form that is a function of a reduced matrix of positions of the sensors and of a reduced matrix of positions of the events;

executing a procedure of singular-value decomposition of said reduced matrix of the measured distances in order to reduce the number of the unknowns in said maximum-likelihood procedure, in particular from three times the sum of the number of sensors and of the number of acoustic sources to nine.

2. The method according to claim 1, further comprising defining a mixing matrix that enables the reduced matrix of positions of the sensors and the reduced matrix of positions of the events to be expressed as a function of matrices performing said decomposition and calculating the values of said mixing matrix by minimizing a respective nonlinear least-squares cost function.

3. The method according to claim 1, further comprising acquiring said times of emission using sources synchronized with the sensors.

4. The method according to claim 1, wherein said operation of obtaining said times of flight as a function of the respective times of emission comprises measuring times of arrival and obtaining the times of flight as difference between the times of arrival and the times of emission.

5. The method according to claim 2, further comprising setting a sensor in a position where a source is located and applying a closed-form-solution procedure to said nonlinear least-squares optimization, in particular obtaining the values of said matrix of estimated positions of the sensors and said matrix of estimated positions of the sources from a right triangular matrix obtained from said mixing matrix via QR decomposition.

6. The method according to claim 5, further comprising using the estimation of position obtained via said solution, in particular said closed-form solution, as initial estimate for a gradient-descent self-calibration procedure.

7. The method according to claim 1, further comprising arranging one of said sensors in a position such that it may be reached by acoustic waves emitted by each transducer and one of said transducers in a position so that it can reach all the sensors of said set of sensors.

8. The method according to claim 7, further comprising recovering missing distance data in the reduced matrix of the distances by:

calculating matrices designed to reduce the unknowns in bilinear form on the basis of matrices of said singular-value decomposition;

introducing variables representing the non-observed values of the reduced matrix instead of the missing distance data in the reduced matrix; and iteratively solving the optimization of a cost function of said variables and of said matrices designed to reduce the unknowns in bilinear form.

9. The method according to claim 1, further comprising locating a single transducer in different spatial locations at successive instants of time.

10. A system for self-calibration of the position of a set of sensors of acoustic signals, arranged in a region of space, comprising, arranged in said region of space, a set of transducers designed to generate acoustic waves or a single transducer that is set in different spatial locations at successive instants of time, configured for implementing the self-calibration method according to claim 1.

11. A non-transitory storage medium readable by a processor and storing instructions for execution by the processor to perform the method according to claim 1 when the product is run on a computer.

12. The method of claim 1 wherein the sensors comprise microphones.

* * * * *